United States Patent [19]

Holtgreve

[11] Patent Number: 5,005,328

[45] Date of Patent: Apr. 9, 1991

[54] ROOFING VENT COVER WITH PLUG DETENT CONNECTION

[75] Inventor: Johannes Holtgreve, Schwelm, Fed. Rep. of Germany

[73] Assignee: Johannes Klöber, Ennepetal, Fed. Rep. of Germany

[21] Appl. No.: 408,121

[22] Filed: Sep. 15, 1989

[30] Foreign Application Priority Data

Oct. 21, 1988 [DE] Fed. Rep. of Germany ... 8813239[U]

[51] Int. Cl.[5] ..... E04B 7/00

[52] U.S. Cl. ..... 52/199; 52/303; 98/42.23; 98/122

[58] Field of Search ..... 52/199, 303, 209; 98/42.23, 42.22, 122

[56] References Cited

U.S. PATENT DOCUMENTS

| | | | |
|---|---|---|---|
| 1,381,630 | 6/1921 | Goodrich | 98/42.22 X |
| 3,238,862 | 3/1966 | Smith et al. | 98/42.23 X |
| 4,080,083 | 3/1978 | Malott | 52/199 X |
| 4,206,692 | 6/1980 | Johnston | 52/199 X |
| 4,397,225 | 8/1983 | Patton | 98/122 X |
| 4,593,504 | 6/1986 | Bonnici et al. | 52/199 |
| 4,697,500 | 10/1987 | Hisey | 98/122 X |
| 4,850,166 | 7/1989 | Taylor | 52/199 |
| 4,909,135 | 3/1990 | Greko | 98/42.23 |
| 4,955,167 | 9/1990 | Holtgreve | 98/122 X |

FOREIGN PATENT DOCUMENTS

| | | | |
|---|---|---|---|
| 165018 | 12/1985 | European Pat. Off. . | |
| 263284 | 4/1988 | European Pat. Off. . | |
| 1609951 | 6/1970 | Fed. Rep. of Germany | 98/42.23 |
| 2155015 | 5/1973 | Fed. Rep. of Germany | 98/42.22 |
| 2320602 | 11/1974 | Fed. Rep. of Germany | 52/199 |
| 8712217 | 9/1987 | Fed. Rep. of Germany . | |
| 2376274 | 7/1978 | France . | |
| 8200336 | 2/1982 | PCT Int'l Appl. . | |

*Primary Examiner*—David A. Scherbel
*Assistant Examiner*—Lan Mai
*Attorney, Agent, or Firm*—Martin A. Faber

[57] ABSTRACT

A roofing slab (1) is developed in the form of a dormer, having a tube connection socket (9) provided on its lower side and a cap-shaped hood provided on its upper side, the hood leaving air passage openings free. For simplified association of the tube connection socket, a plug-detent connection is provided between hood (2) and arms (St) of the roofing slab (1), the arms lying below the hood (2). An insertion opening (E) is provided in an inner space between the plug-detent means for receiving the tube connection socket (9) which is held by resting on the arms.

8 Claims, 3 Drawing Sheets

ROOFING VENT COVER WITH PLUG DETENT CONNECTION

FIELD AND BACKGROUND OF THE INVENTION

The present invention relates to a roofing slab, or vent cover, developed in the form of a dormer, with hose, or stack, connection socket provided on its bottom side and a cap-shaped hood arranged on its top side, leaving air passage channels free.

A roofing slab of this type is known from Federal Republic of Germany utility Model 86 26 769. In that case, the hose connection socket is held on an edge collar of the bottom side of the roofing slab by means of attachment screws. These points of attachment are located on a shell body which is developed on the hose connection socket and grips over the collar. A total of four attachment places are provided.

The object of the present invention is so to develop a roofing slab of this type, in a manner which is simple to manufacture and is advantageous from a construction standpoint, that, while retaining the advantageous optional association of the hose connection socket, the association is simplified.

SUMMARY OF THE INVENTION

According to the invention this object is achieved by the invention, by a plug-detent connection between hood (2) and arms (St) of a roofing slab (1) lying below the hood (2), and by an insertion opening (E) provided in an inner space (6) between the plug detent means, for a tube connection socket (9), which is held by resting on the arms.

As a result of this development, a roofing slab of this type which is of increased value in use is obtained. The arrangement of the hose connection socket is simpler, even while dispensing with special attachment means. This is achieved by a plug-detent connection between hood and arms of the roof slab which lie below the hood, and an insertion opening, provided in the inner space between the plug-detent means for the hose connection socket, which is held by resting on the arms.

A corresponding accessibility is checked via a detent association of the hood. A reversible plug association is involved so that, in addition to reequipment or conversion at any time, the possibility is also always present of removing the hose connection socket easily, without the use of tools.

It has been found that the mere resting on the arms is completely sufficient, if only on basis of the weight itself of the hose connection socket. An even more intimate resting results from the weight of the hose line or pipe line to be connected with the hose connection socket. On the other hand, however, it is also sufficient to apply a spot of glue, for instance, in order to obtain assurance against twisting.

A particularly favorable development of the plug-detent means in accordance with a further feature, is formed by hollow pins which enter into detent holes in the arms. Such hollow pins not only result in a saving of material but also favor the flexibility of the plug-detent means, a conical tapering having a centering action. The feeling of the position of the connection, which is concealed, is thereby made far easier. Furthermore, it is proposed that the arms be developed as transverse wall sections of a collar which protrudes upward on the roofing slab. This may also be a coherent transverse wall which imparts high inner stability to the roofing slab also as a result of the difference in planes. By suitable upward displacement of the transverse wall sections, sufficient space remains below same for the passage of the free ends of the hollow pins. They then, for example, do not come into contact with the boarding of the roof. Furthermore, it is advantageous for the top of the arms to form the resting surface for the flange of the hose connection socket. Such a flange, which is developed in advance on the hose connection socket, results in a balanced, i.e. tilt-free, resting and furthermore stabilizes the generally cylindrical connecting socket. The lower side of the flange may serve as glue application surface, as indicated above.

Finally, it is advantageous for the cap walls of the hood to terminate approximately at the height of the plug connection places and extend on all sides spaced from the collar. This results in equal ventilation cross sections in all directions. As a result of corresponding spacing of the hood from the upper side of the roofing slab, there is also created a sufficient under-engagement space to remove the hood for inspection purposes or the like. Finally, there is also the advantage that the center of the flat-pyramidal top side of the hood is aligned with the central axis of the hose connection socket. A corresponding development favors the centrally oriented construction.

BRIEF DESCRIPTION OF THE DRAWINGS

The object of the invention is explained in further detail below on basis of an embodiment shown in the drawing, in which.

DETAILED DESCRIPTION OF THE PREFERRED EMBODIMENT

The roofing slab 1, which is developed in the form of a dormer, is closed on its top by a hood 2.

The roofing slab 1 is of rectangular contour. Its longer edge points in the direction of the roof slope.

Figure 1:
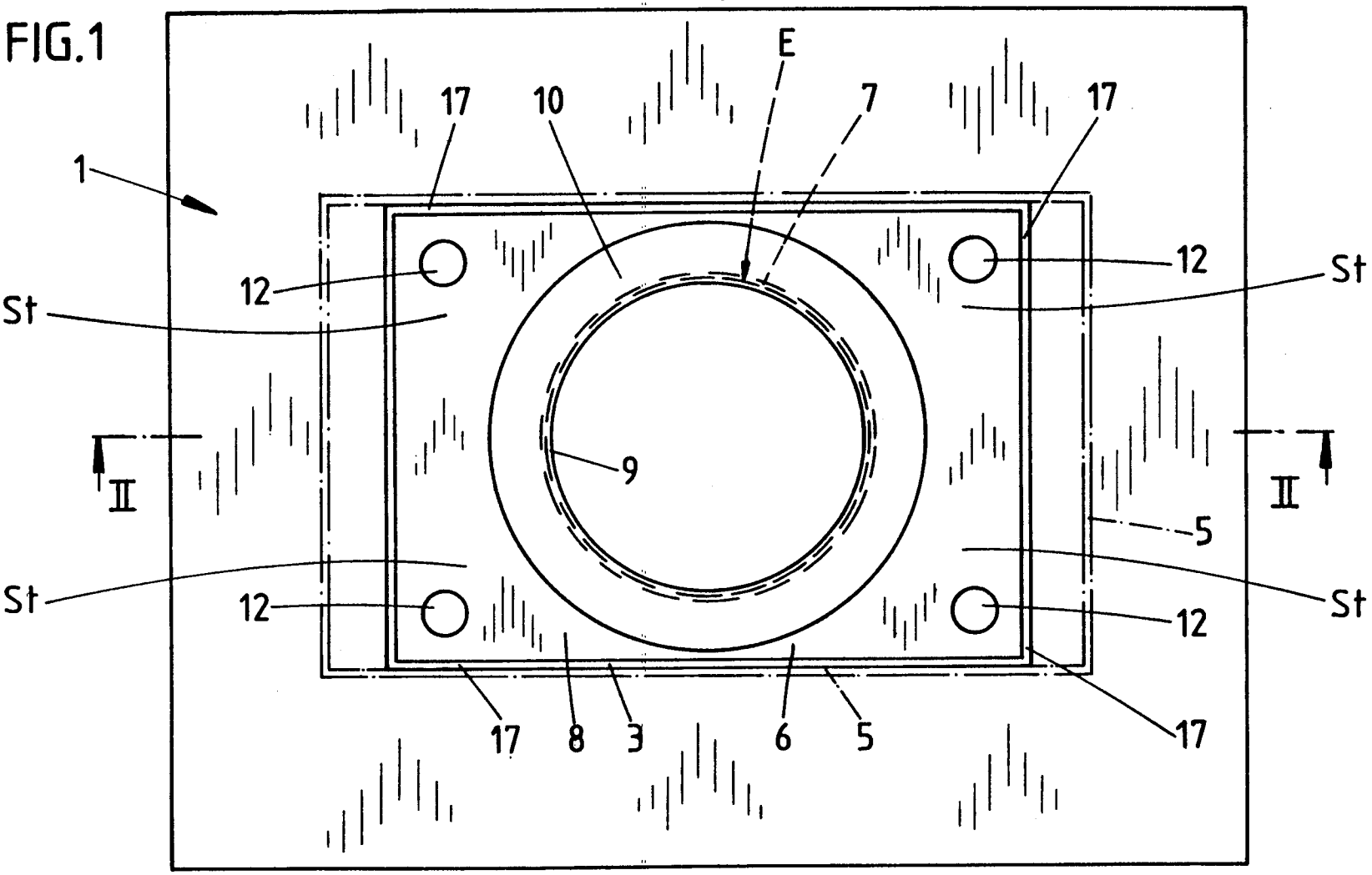
FIG. 1 is a top view of the roofing slab with associated hose connection socket and hood, which has not yet been applied.
Figure 2:
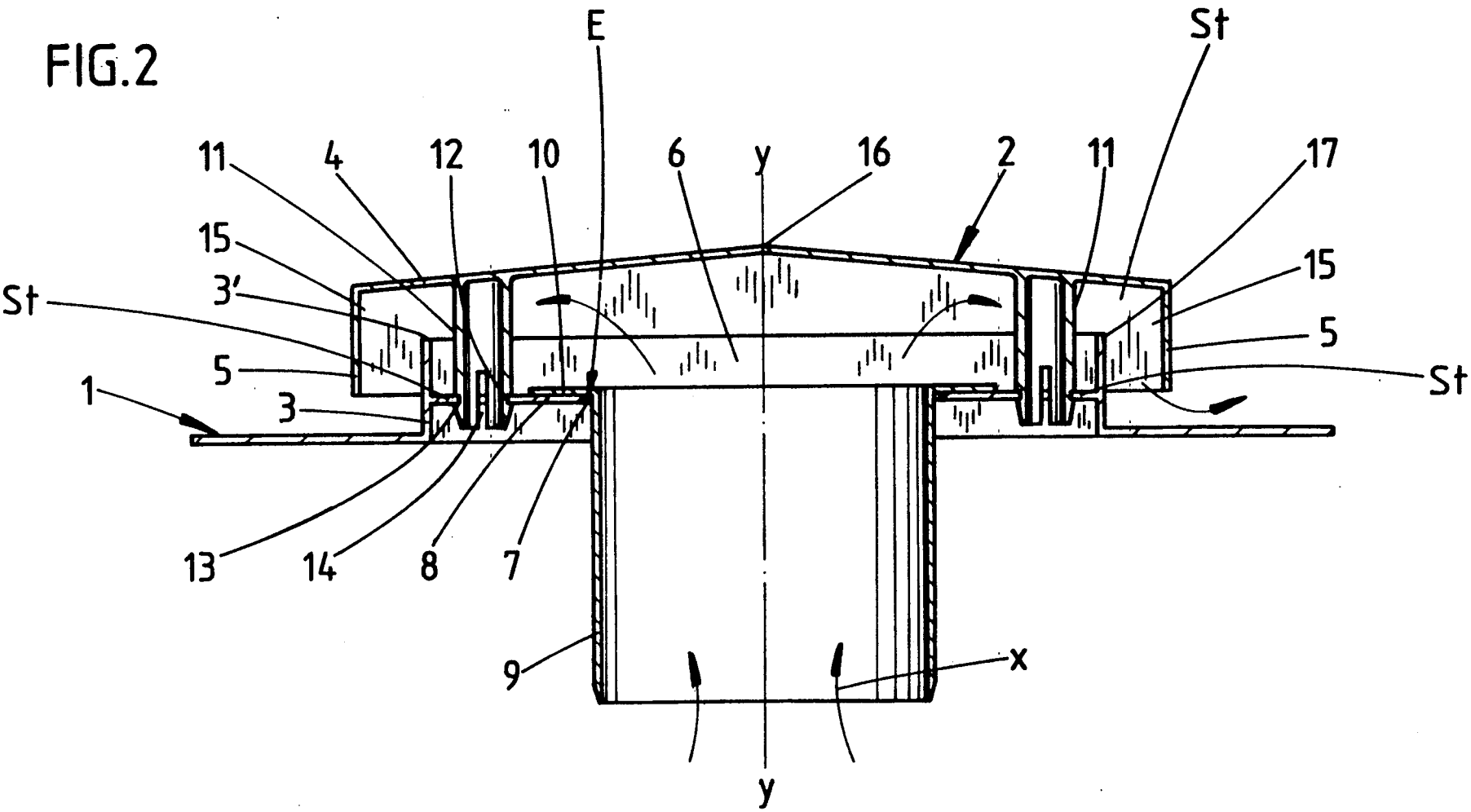
FIG. 2 is a section along the line II—II of FIG. 1, but with the hood.
Figure 3:
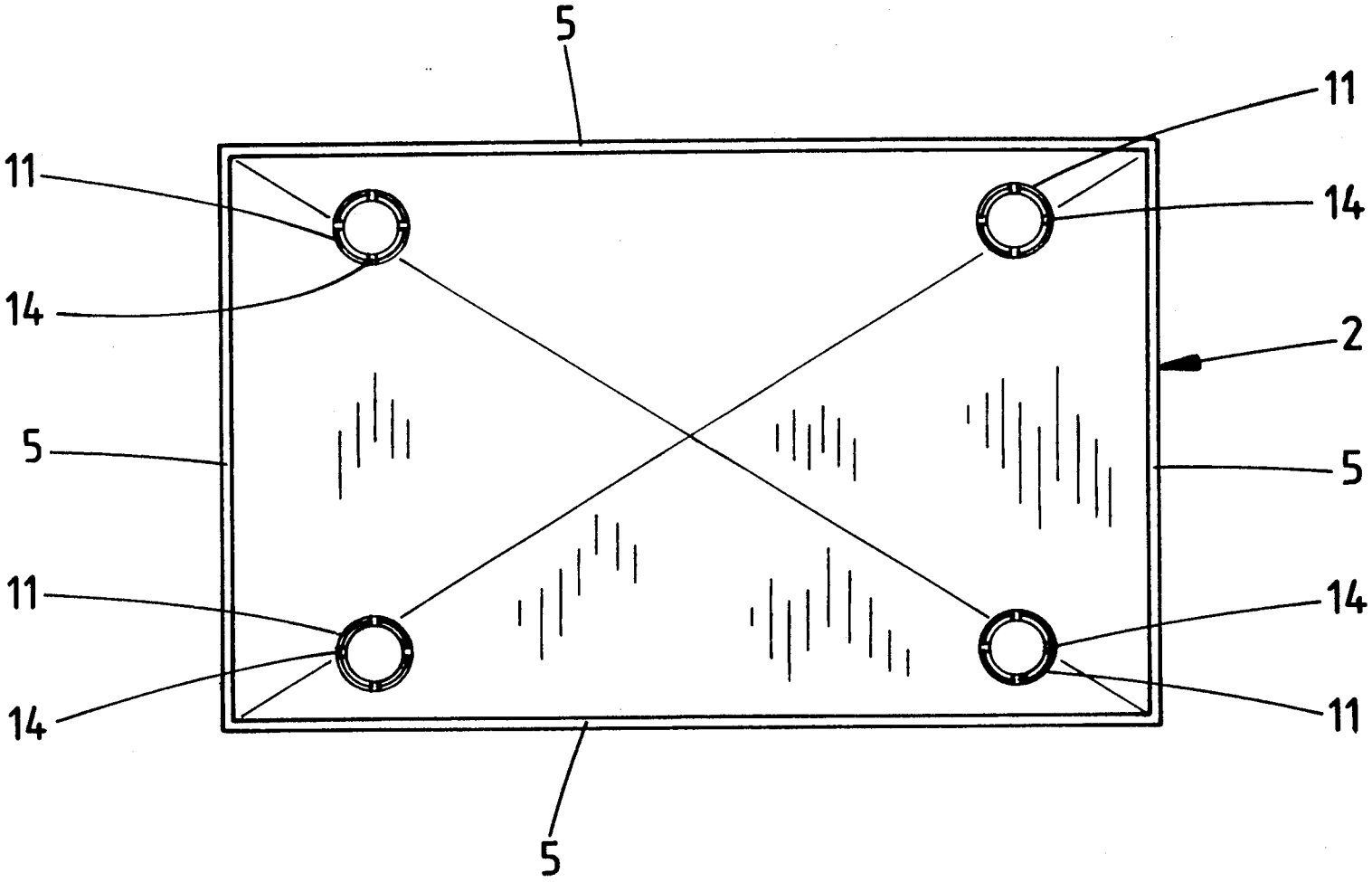
FIG. 3 is a bottom view of the hood.

Centrally, the roofing slab forms an upward-protruding collar 3. The latter is also of rectangular contour, as can be noted from FIG. 1.

The cover 4 of the hood 2 terminates at a vertical distance in front of the front side 3' of the collar 3. Similarly, the vertical cap walls 5 terminate at a horizontal distance from the outer surface of the collar 3. In this way, a covered ventilation path x is left which extends centrally through the roofed inner space 6 of the ventilation dormer. The corresponding roofing-slab-side passage opening bears the designation 7. It is a circular opening in the center of the ventilator dormer.

The passage opening 7 is formed in a horizontal transverse wall 8 of the roofing slab 1.

For the associating of a hose connection socket 9, the passage opening 7 serves as insertion opening E. The plug association is effected from above with the hood 2 removed. The top side of the transverse wall 8 serves as support surface for a horizontally outwardly angled flange 10 which is formed on the hose connection socket 9.

For the corresponding accessibility of the inner space 6 of the ventilator dormer, the hood 2 can be associated in the manner of a reversible plug-detent connection. The hood-side plug detention means consist of downward-directed hollow pins 11. The latter extend from the bottom of the cover 4. As a whole, four such hollow pins are developed thereon. The dome of the hollow extends up into the cover plane. The substantially cylindrical hollow pins 11 are conically tapered towards the free end on their outer side, so as to obtain a centering action with respect to the mating detent means in the form of congruently arranged detent holes 12 in the transverse wall 8.

On the outer surface of the hollow pins 11, spaced from the free end thereof, there is provided a detent groove 13. It surrounds the edge of the circular detent hole 12. In order to obtain the indicated possibility of eliminating the detent connection, the free end of each hollow pin 11 is transversely slit, in particular with a crosswise slitting. The crosswise slits bear the reference number 14. The slit width and length are so selected that a radial pressing together of the head end of the hollow pin, which is possible from the lower side of the roofing slab, results in a reduced diameter or cross section which is less than the inside diameter of the detent hole 12.

In order that the heads of the hollow pins 11 do not protrude beyond the bottom of the roofing slab, the transverse wall 8, which is rooted in the inner side of the collar 3, is shifted upwards by the corresponding amount. It is therefore not aligned with the slab body of the roofing slab 1.

Instead of the transverse wall 8, which is rooted circumferentially in the entire collar wall, the mating detent means which have the detent holes 12 can also be developed in the form of freely radially inward extending arms St. The latter extend up to the (covered) edge of the passage opening 7, so that the cylindrical hose connection socket 9 is also in this way defined in position.

In the embodiment shown, the arms St are pulled together to form transverse-wall sections or even shaped into a completely continuous transverse wall 8 with central passage opening 7.

Since the cap walls 5 of the hood 2 terminate approximately at the height of the upwardly shifted plug connection places (detent hole 12/detent groove 13), there is sufficient under-engagement space for the withdrawal of the hood 2. This, however, is possible only if a second person compresses the hollow pins 11, so that misuse is made difficult. The free space created by the horizontal distance from the collar 3, which is possible on all sides, forms the so-called "air passage channels" 15 at least on the ridge and eaves sides. On the other hand, the longitudinal sections of the cap walls 5 can rest on the longitudinal sides directly against the corresponding outer surface of the collar 3 (see the hood 2 entered in dash-dot lines in FIG. 1).

The hood 2, and its cover 4, is developed as a flat pyramid on its upper side. The apex 16 of the pyramid of the hood 2 lies in the longitudinal central axis y—y of the hose connection socket 9.

In the plane transverse to the air passage channels 15, the flange assumes greater closeness to the inside of the collar 3 than in the plane transverse thereto.

The detent holes 12 are located in the areas of the transverse wall 8 which are particularly stiffened by the corners 17 of the collar 3.

The hose connection socket 9 can be connected with a flex hose or a tube, not shown in detail. A clamp can serve as fastening element.

The weight of the hose connection socket 9 itself, and the possibly additional load of the said hose, etc., lead to a snug resting of the flange 10 on the top of the transverse wall 8 and of the arms St forming it.

I claim:

1. A roofing vent cover having the shape of a dormer, the vent cover comprising a tubular section provided on a lower side of the vent cover, said tubular section having a periphery at an upper end of the tubular section;

an arm assembly having a plurality of arms extending from said periphery radially outward of said tubular section;

a cap-shaped hood located on an upper side of the vent cover and spaced-apart from said arm assembly to leave free air passage channels between said hook and said arm assembly;

plug-detent connection means for securing said hood to said arm assembly, said plug-detent connection means being disposed between said hood and said arm assembly, there being an insertion opening provided in an inner space of the hood between elements of the plug detent connection means for receiving said tubular section; and wherein said arms form a wall of a roof cover plate transverse to an axis of said tubular section, the transverse wall including a web which forms a part of said plug-detent connection means to enable engaging the plug-detent connection means extending from the hood into the transverse wall of the roof cover plate which forms the web.

2. A roofing vent cover according to claim 1, wherein said arms include detent holes forming a part of said plug-detent connection means; and said plug-detent connection means further comprises a set of hollow pins which enter into the detent holes of said arms.

3. A roofing vent cover according to claim 7, wherein said hollow pins are conical and slit on their free ends.

4. A roofing vent cover according to claim 1, wherein said arm assembly further comprises a collar surrounding and spaced apart from said insertion opening; and wherein said collar contacts outer portions of said arms distant from said tubular assembly, and said arms extend transversely of said collar, said collar protruding in an upwards direction of said roofing vent cover.

5. A roofing vent cover according to claim 1, further comprising a flange extending laterally from the periphery of said tubular section and around said insertion opening for engaging with said arm assembly; and wherein a top surface of said arm assembly contacts said flange.

6. A roofing vent cover according to claim 1, wherein said hood comprises cap walls which extend downwardly at a periphery of said hood to terminate approximately at the height of said plug detent connection means.

7. A roofing vent cover according to claim 6, wherein said cap walls extend on all sides of said vent cover, and are spaced apart outwardly at a distance from said collar.

8. A roofing vent cover according to claim 1, wherein said hood has a flat pyramidal upper side; and wherein a center of the flat-pyramidal upper side of the hood is aligned with a central axis of said tubular section.

* * * * *